US005131996A

United States Patent [19]

Birkle et al.

[11] Patent Number: 5,131,996

[45] Date of Patent: Jul. 21, 1992

[54] SURFACE-TREATING APPARATUS FOR AGITATABLE MATERIAL

[75] Inventors: Siegfried Birkle, Höchstadt; Johann Gehring, Spardorf, both of Fed. Rep. of Germany

[73] Assignee: Siemens Aktiengesellschaft, Berlin & Munich, Fed. Rep. of Germany

[21] Appl. No.: 623,213

[22] Filed: Dec. 6, 1990

[30] Foreign Application Priority Data

Dec. 22, 1989 [EP] European Pat. Off. ..... 89123785

[51] Int. Cl.[5] ..... C25D 17/16; B65G 37/00

[52] U.S. Cl. ..... 204/198; 204/222; 204/273; 204/202; 204/275; 198/603; 198/609; 209/920

[58] Field of Search ..... 204/198, 222, 273, 275, 204/202; 198/603, 609; 209/920

[56] References Cited

U.S. PATENT DOCUMENTS

| | | | |
|---|---|---|---|
| 139,556 | 6/1873 | Eames | 198/603 X |
| 205,012 | 6/1878 | Tiernan | 198/603 X |
| 3,224,553 | 12/1965 | Campbell | 198/609 X |
| 3,420,766 | 1/1969 | Michelson | 204/222 X |
| 3,826,355 | 7/1974 | Faust | 198/220 |
| 4,670,120 | 6/1987 | Birkle et al. | 204/222 X |
| 4,969,985 | 11/1990 | Birkle et al. | 204/222 X |

FOREIGN PATENT DOCUMENTS

| | | |
|---|---|---|
| 2719641 | 11/1978 | Fed. Rep. of Germany . |
| 2145744 | 2/1973 | France . |

*Primary Examiner*—Donald R. Valentine
*Attorney, Agent, or Firm*—Kenyon & Kenyon

[57] ABSTRACT

An apparatus is provided for surface treating agitable material that includes a conveyor trough for transporting the agitatable material. The trough is at least partially submerged in a treatment bath and it includes at least a first and second shaking chute each having a length along which the material is conveyed. The first and second chutes are disposed at angles from the horizontal such that the conveying direction of the first chute is substantially opposite to the conveying direction of the second chute.

26 Claims, 4 Drawing Sheets

SURFACE-TREATING APPARATUS FOR AGITATABLE MATERIAL

BACKGROUND OF THE INVENTION

The invention relates generally to a surface-treating apparatus for agitatable material, and more particularly to an improved conveyor trough of an apparatus for galvanically depositing aluminum from an aprotic, oxygen-free and anhydrous aluminum organic electrolytic solution.

It is known that the life span of metallic components can be extended by surface finishing the metallic components. New applications for these surface finished components may be found as well. For example, light metal and ferrous material coatings effectively protect relatively non-precious metals whose surfaces can corrode under the effects of the atmosphere. By using an appropriate pretreatment, the components are given a polished surface free of any unwanted surface film. The metallic coating may also be supplemented by a secondary treatment.

During galvanic treatment, the agitatable small parts must be held together so that the parts make electrical contact with each other. However, the agitatable material to be treated also needs to be sufficiently spread out so that the metallic deposition can be performed over as great a surface area as possible. By satisfying this requirement, an optimally uniform current density is provided on all the parts as well. A further important prerequisite for achieving perfect metal platings with a uniform layer thickness is that the material must be thoroughly mixed during the galvanic treatment. The known devices for electroplating are equipped with conveyors for transporting the agitatable material through an electrolytic solution. A continuous or periodic admission and removal of the material is accomplished via corresponding admission and exit sluices. An additional requirement is that, the agitation, mixing, and transport of the material through the electrolyte should be carried out so that the material is treated gently and so that sensitive parts are not mechanically damaged during galvanic treatment.

These above-mentioned requirements are not only significant in regard to electroplating, such as in mass electrolytic surface plating. These requirements are also significant in regard to the electrochemical surface treatment of agitatable material in liquids, such as during electrolytic degreasing in alkaline baths as well as during electrolytic pickling or electrolytic polishing. During electrolytic surface treatment, the agitatable material is wired either as a cathode or as an anode. For example, the circuit arrangement is such that the agitatable material acts as an anode during electrolytic polishing, but during the deposition of aluminum the agitatable material is preferably wired to act as a cathode.

An apparatus suitable for mass electroplating, particularly for the galvanic deposition of aluminum, is known in the art. This known apparatus has a vibrating conveyor with horizontal and vertical vibrating components to transport the agitatable material through the treatment bath. This apparatus contains an oxygen-free and anhydrous electrolytic solution having an inner surface covered by an inert gas. The admission of air and moisture into the device must be prevented. For this reason, gas, liquid or vacuum sluices are provided to load and remove the agitatable material that is to be processed. By utilizing inertial force, the vibrating conveyor transports the agitatable material along a fixed conveying route that is either horizontal or inclined. Vibrators having a skew effect or tilted guide levers, for example, may serve as the driving mechanisms. These types of driving mechanisms produce vibrations such that the material is periodically lifted off the support, thus undergoing a series of microprojectile type motions. As a result, the material is transported in the direction of conveyance. In addition, gravity conveyors in the form of downspouts may be provided. Such gravity conveyors only require a relatively small motive force to operate and they allow the gentle conveyance of the agitatable material. The result obtained is a very effective movement of the material as well as good electrolytic exchange and uniform current absorption over the entire active surface of the material that is now spread out.

The apparatus for surface-treating agitatable material disclosed in U.S. Pat. No. 3,826,355 includes a conveyor trough which is angularly disposed in only one direction and has a sawtoothed floor. The agitatable material executes projectile motion with an upward component. To accomplish this motion, a rocking driving mechanism is provided for the conveyor trough. In this particular embodiment, the agitatable material can be lifted-up from the conveyor trough while it is in motion. Accordingly, the degree of contact is minimal.

In view of the prior art, there is a need to simplify and improve the known devices for surface-treating agitatable material. More particularly, there is a need to improve the intermixing of the material, to increase the spectrum of materials to be deposited and, to reduce the overall space that is required.

SUMMARY OF THE INVENTION

According to the present invention, this task is accomplished by providing an apparatus for surface treating agitatable material that includes a conveyor trough for transporting the agitatable material. The trough is at least partially submerged in a treatment bath and it includes at least a first and second shaking chute each having a length along which the material is conveyed. The first and second chutes are disposed at angles from the horizontal such that the conveying direction of the first chute is substantially opposite to the conveying direction of the second chute.

Since the conveyor trough is formed as a shaking chute disposed at an angle that has a back and forth movement, the agitatable material is constantly being accelerated downward and carried along until it overcomes the frictional force of the static friction. From that point on, as well as during its upward motion, it slides as the result of its kinetic energy, until this energy is absorbed by the sliding friction. The agitatable material is thus moved without being lifted off of the conveyor trough. As a result, the agitatable material always remains in electrical contact with the electrical contacts provided in the conveyor trough. The material transported on the chute falls from one chute to the next so that the material is rotated and well intermixed while undergoing a laminar-type motion. The result is an adequately uniform deposition over the entire agitatable material.

The chute can have almost any width desired. Thus, this apparatus can process individual agitatable parts that are larger than could be processed in the known devices. In one particular embodiment of the apparatus, the width of the chute perpendicular to the direction of motion can be chosen to be at least as great as the length of the chute in the direction of motion. If the width of the shaking chute is chosen to be greater than its length, the agitatable material will be well intermixed and thus a uniform deposition will result. If the length of the shaking chute is greater than its width, the dwell period of the agitatable material on the shaking chute is long compared to the transport time on the material transport apparatus. Thus, a correspondingly high deposition rate is obtained.

An admission sluice is arranged above the chutes. The sluice may, for instance, be formed as a vacuum sluice or as an exit sluice and it may load essentially the entire width of the upper chute. In one particular embodiment, this admission sluice may form a double sluice (a so-called tandem sluice). In this embodiment, one of the two sluices is always ready to be emptied onto the shaking chute.

All of the shaking chutes taken together yield a zigzag configuration. The downward inclination of the chutes in the direction of motion alternate from one chute to the next. Furthermore, the chutes can be advantageously provided with a single common driving mechanism that drives them all.

In another embodiment of the invention, only the second shaking chute, and possibly subsequent shaking chutes, makes electrical contact. The upper shaking chute, which does not make electrical contact, serves only to uniformly propagate and distribute the agitatable material on the chute surface and thus acts as a so-called homogenizer. To better distribute the agitatable material, this chute may also be perforated. Additionally, an anode may be advantageously provided at least to the part of the upper shaking chute on which the agitatable material is transported after being evacuated from a tilting apparatus 51.

DETAILED DESCRIPTION

Figure 1:
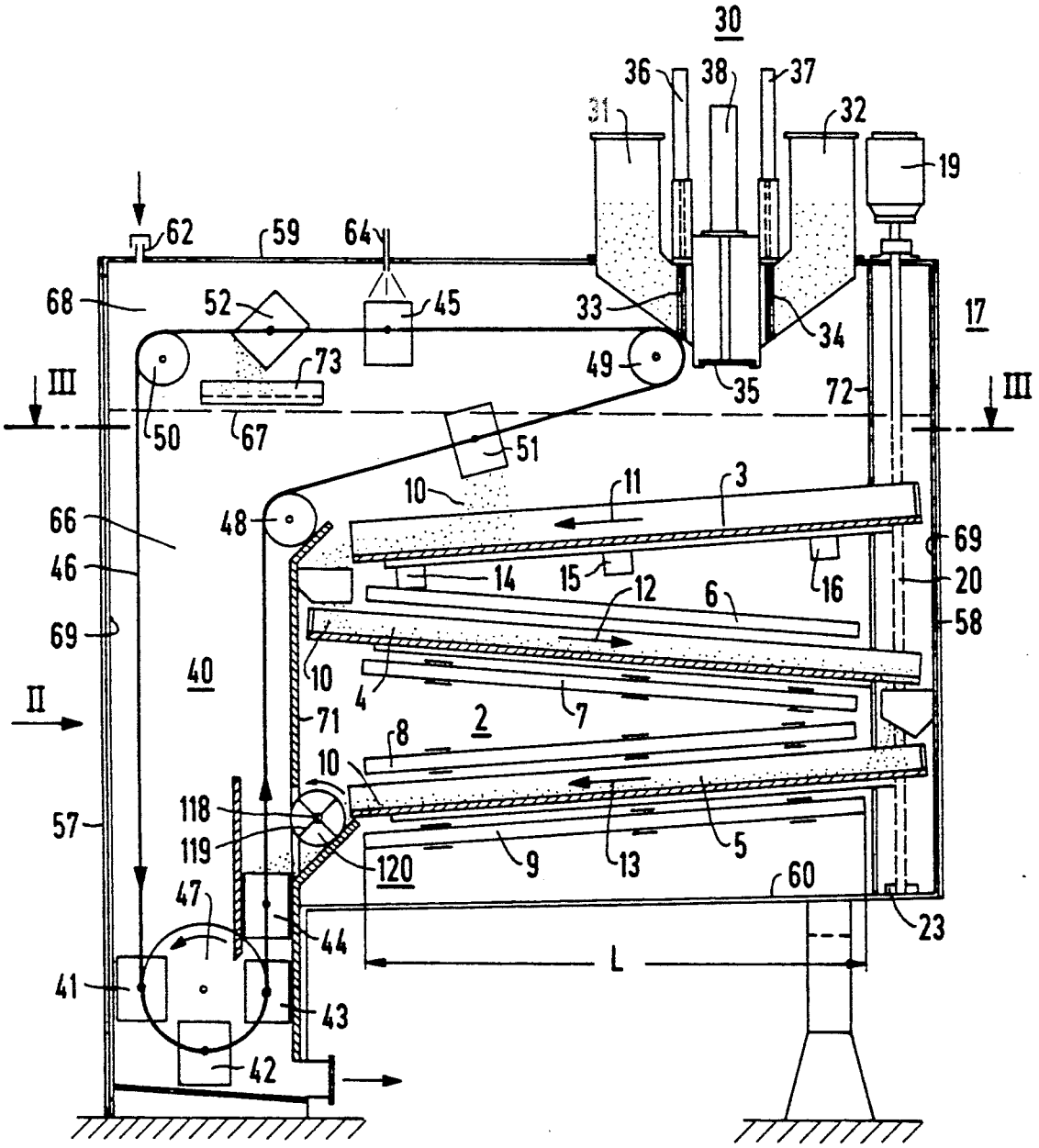
FIG. 1 is an elevational cross-sectional view of the surface treating apparatus constructed according to the principles of the invention.

FIG. 1 shows an apparatus for the electroplating of agitatable material. The apparatus, which may be used for galvanically depositing aluminum from aprotic, oxygen-free and anhydrous aluminum organic electrolytes, contains a conveyor trough 2. The conveyor trough 2 includes three shaking chutes 3, 4 and 5. The upper shaking chute 3 preferably does not make electrical contact and therefore simply serves as a homogenizer. Two sets of anodes 6, 7 and 8, 9 may be assigned to the shaking chutes 4 and 5, respectively. One anode of each set lies above its corresponding chute and the other anode of each set lies below its corresponding chute. The chutes 4 and 5 may each be wired as cathodes. The length of the shaking chutes that is used for deposition is roughly a function of the length L of the anodes 6 to 9. The length L may be as great as 80 cm. In the particular embodiment shown, the shaking chutes 4 and 5 are perforated. As a result, there is conduction of current between the anodes 7 and 9 and the agitatable material 10 to be processed. The agitatable material 10 is indicated in FIG. 1 merely by dots inside the shaking chutes 4 and 5. The shaking chutes 3 to 5 are movably supported on bearing blocks 14 to 16, of which only three are shown in FIG. 1 for simplicity. The angle of inclination of the shaking chute, not shown in great detail in FIG. 1, is essentially determined by the agitatable material 10. The conveyor trough 2 has two driving mechanisms assigned to it, of which only the driving mechanism 17 is visible in FIG. 1. The driving mechanism 17 includes a driving motor 19 that preferably has a variable rotational frequency, and at least one driving shaft 20, which is provided with a cam for each of the shaking chutes. The cams are not visible in FIG. 1. By varying the rotational frequency of the driving mechanism 17, the dwell period of the agitatable material 10 on the shaking chutes 3 to 5 can be adjusted. A bearing 23 is provided at the lower end of the driving shaft 20.

An admission sluice 30 is provided above the conveyor trough 2, which is preferably designed with two-chambers, forming a so-called tandem sluice. The two sluice chambers are designated by reference numerals 31 and 32. The lower ports of the sluice chambers 31 and 32 are each sealed by a blocking slide valve 33 and 34, respectively, via lifting elements 36 and 37. A sealing plate 35 seals the common port above the homogenizer. The size of the sealing plate 35 is such that approximately the entire width of the shaking chute 3 can be loaded with the agitatable material 10 by means of the admission sluice 30. The blocking slide valves 33 and 34 are separately controllable and control the admission sluice 30. In addition, the sealing plate 35 is provided with a lifting element 38. The sluice chambers 31 and 32 may each be hermetically sealed by a cover, which will not be described further. In this particular embodiment of the admission sluice 30, the shaking chute 3 can be alternately loaded from one of the two sluice chambers 31 and 32.

The conveyor trough 2 is also provided with a material transport apparatus 40, which includes material baskets 41 to 45. The baskets 41 to 45 are transported by a conveyor belt 46 or possibly a conveying chain. A conveyor driving mechanism 47 is also provided as part of the transport apparatus 40, which for simplicity is not shown in great detail in FIG. 1, but which may include a driving motor. It is advantageous if the rotational frequency of the driving motor is controllable, thus allowing the dwell period of the agitatable material 10 within the transport apparatus 40 to be adjusted. Guiding pulleys 48 to 50 are used to guide the conveyor belt 46. A tilting apparatus 51 and 52, not shown in great detail in FIG. 1, are merely shown as tilted material baskets.

If the apparatus for surface-treating agitatable material is to treat material 10 that is ferromagnetic, the material transport apparatus 40 may be made from a material that is at least partially magnetizable. In this particular embodiment the material baskets 41 to 45 are unnecessary.

The conveyor trough 2 and the material transport apparatus 40 are preferably arranged in a gastight housing 60, whose side walls include removable covers 57 and 58. The cover 59 contains the admission sluice 30. The housing 60 is provided with a gas supply line 62, (e.g. for nitrogen $N_2$) and a spraying apparatus 64 (e.g. for spraying toluol). The housing 60 contains an electrolyte 66, the top level 67 of which is indicated in FIG. 1. A gas space 68 is situated above the electrolyte 66, which can be filled with a gas such as nitrogen.

The inside of the housing 60 is provided with electrical insulation 69 that is resistant to the electrolytes 66. The insulation 69 advantageously includes a chemically resistant insulating layer, such as phenolic resin. A shielding 71 for shielding fields may be made of hard plastic. Furthermore, a shielding 72 is provided between the active part of the conveyor trough 2 and the driving mechanism 17 for shielding the shaking chutes 3 to 5.

By removing the side wall 58, which may be partitioned, the anodes 6 to 9 can be easily exchanged, as may the shaking chutes 3 to 5, if desired. In the same way, by removing the side wall 57 the material transport apparatus 40 becomes accessible. The material baskets 41 to 45 are shown inside the material transport apparatus 40. The delivery sluice 76 shown in FIGS. 2 and 3 is provided with a driving mechanism, of which only the driving shaft 78 is indicated in FIG. 3.

In the particular embodiment of the apparatus shown in FIG. 1, an apportioning apparatus 120 for the agitatable material 10 is provided between the lower shaking chute 5 and the material transport apparatus 40. The apportioning apparatus 120 includes a shaft 118 extending perpendicular to the direction in which the agitatable material 10 is conveyed. The shaft 118 has lamellar separating walls 119 extending along the axial direction of the shaft 118. The apportioning apparatus 120 is made of electrically nonconductive material, and it periodically feeds the agitatable material 10 supplied by the shaking chute 5 to the material baskets 41 to 45 when they are at the location of basket 44 in FIG. 1. The apportioning apparatus 120 prevents the agitatable material 10 from becoming lodged between the material baskets 41 to 45 and the shielding 71. Furthermore, the apportioning apparatus 120 forms a galvanic separation between the lower shaking chute 5, as well as the anodes 8 and 9, and the electrically conductive parts of the material transport apparatus. The apportioning apparatus 120 is preferably coupled to the conveyor driving mechanism 47 of the material transport apparatus 40.

Figure 2:
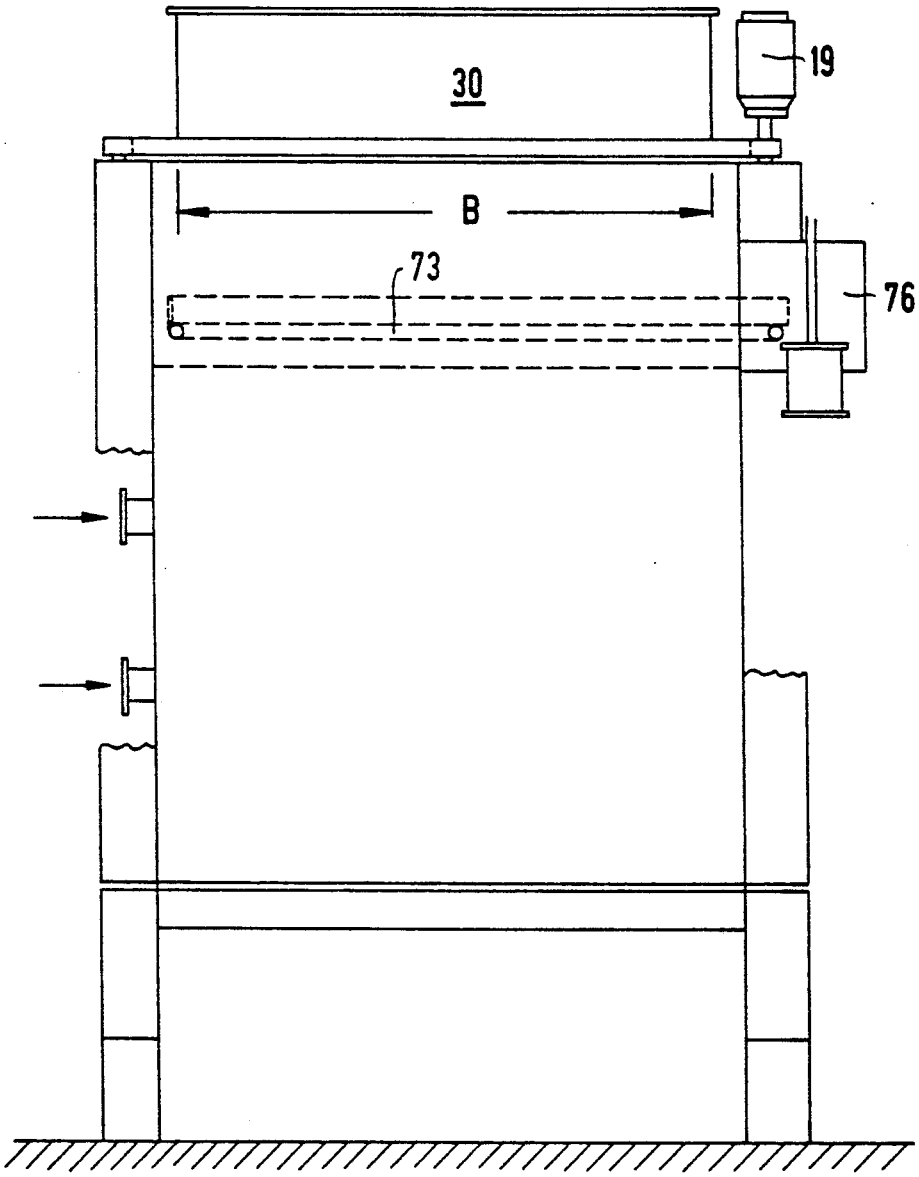
FIG. 2 is a side view of the apparatus shown in FIG. 1.

In the side view of the apparatus seen in FIG. 2, a conveyor belt 73 used for evacuation purposes is indicated by a dashed line. The belt 73 transports the final processed agitatable material 10 to a delivery sluice 76, which is provided with a driving mechanism. The width of the admission sluice 30 corresponds approximately to the width B of the shaking chutes 3 to 5 so that the shaking chutes can be loaded over their entire length by the admission sluice 30. In an installation for coating agitatable material that has a low tolerance for the layer thickness (i.e. uniform deposition), the width B of the shaking chutes 3 to 5 can be chosen to be at least as large as the length L, and preferably considerably greater (e.g. B=120 cm). On the other hand, if the installation is to be used for coating agitatable material at a particularly high deposition rate, the width B may be selected to be less than the length L (e.g. B=40 cm). A driving motor 19 is configured for the chute driving mechanism 17. The motor 19 can be directly coupled to one of the two driving shafts 20 as well as to the second driving shaft. The coupling may be accomplished by means of a toothed belt or a drive chain, for example.

Figure 3:
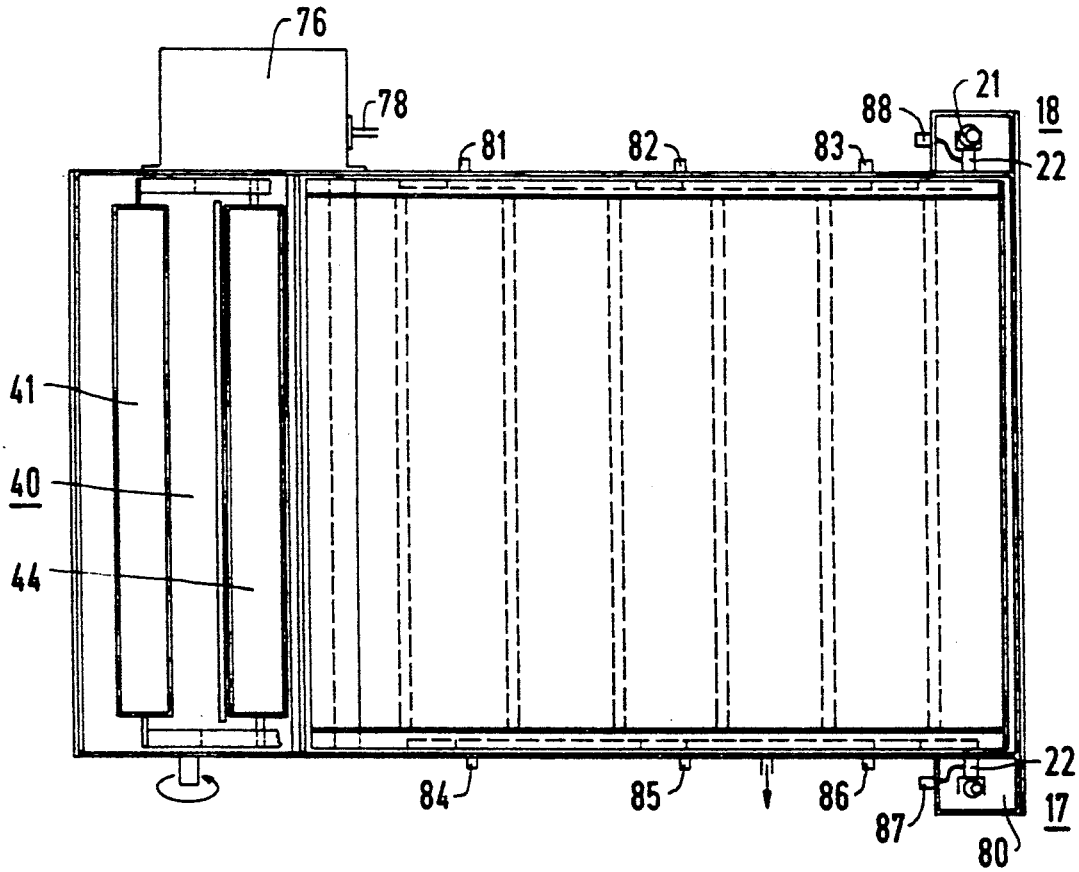
FIG. 3 is a cross-sectional view taken along line III—III in FIG. 1.

The plan view shown in FIG. 3 illustrates the two cams 21 and their allocated engaging pieces 22 of the chute driving mechanisms 17 and 8. Anode leads 81 to 86 are depicted in the side walls, and cathode leads 87 and 88 are depicted in the driver housing 80. The anode leads 81 to 86 and the cathode leads 87 and 88 are electrically insulated from the housing 60 and are also chemically resistant to the electrolytes 66.

Figure 4:
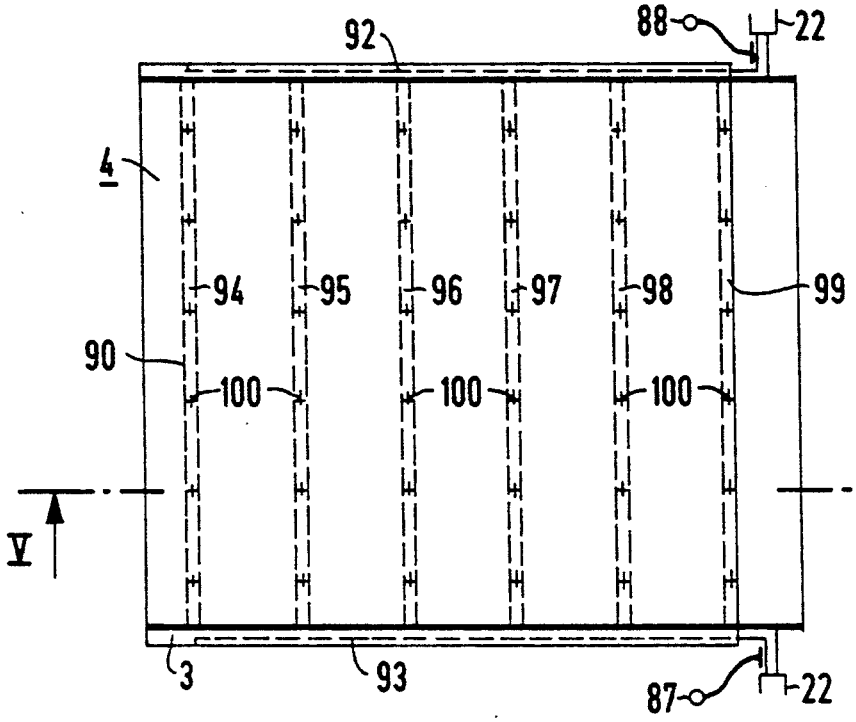
FIGS. 4 and 5 show an embodiment of the apparatus having a supporting frame mounted below a shaking chute.
Figure 5:
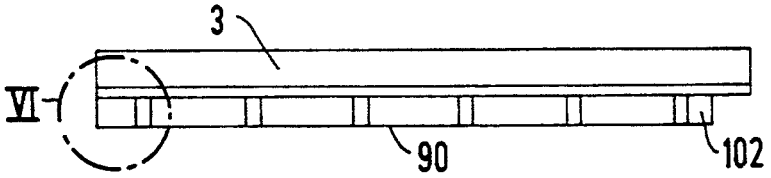

In the particular embodiment of the invention shown in FIGS. 4 and 5, a supporting frame 90 can be constructed and mounted below a shaking chute (e.g. chute 4) in such a way that it forms a mechanical mounting support and a closed current-supply system for the shaking chute. The chemical and electrical insulation of the supporting frame 90 is not shown for simplicity. The supporting frame 90 includes two limiting strips 92 and 93 and six pipes 94 to 99. The two laterally secured (e.g. by welding) limiting strips 92 and 93 are interconnected by the pipes 94 to 99, which are preferably square. The pipes 94 to 99 may, for example, be formed of steel and contain an electrically conductive core. The pipes 94 to 99 are attached to the shaking chute 4 by means of six contact screws 100, which are indicated in FIG. 4 simply by crosses. The contact screws 100 form both a mechanical connection and a conductor for current. The cathode leads 87 and 88, which are only schematically illustrated in FIG. 4, are electrically insulated from the engaging pieces 22 of the eccentric drives 17 and 18.

Figure 6:
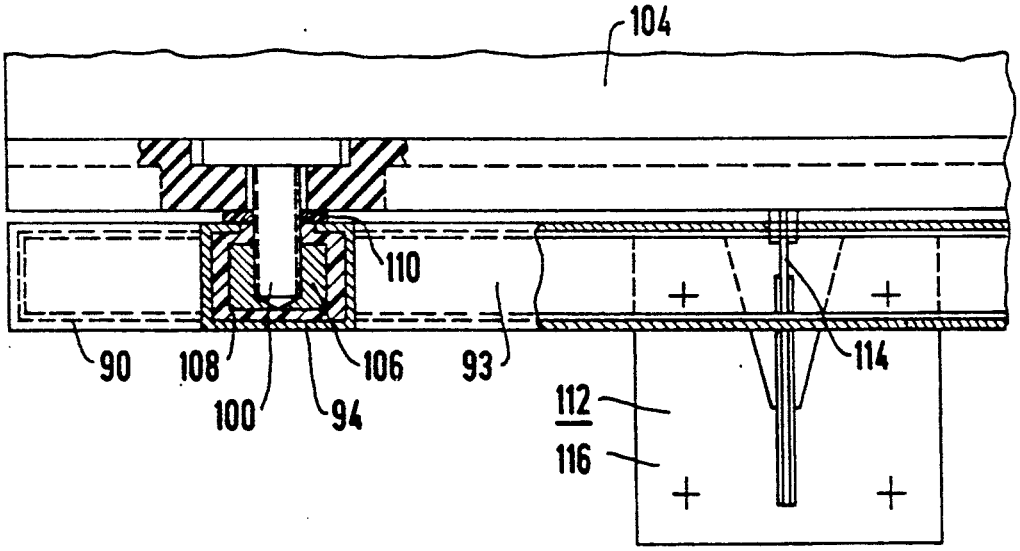
FIG. 6 shows the electrical contact formed between a shaking chute and the supporting frame.

FIG. 6 shows a particular configuration of the electrical contact between the shaking chute 4 and the supporting frame 90. As seen in FIG. 6, one of the contact screws 100 is provided with an enlarged head and is inserted in a slideway 104, which may be made of a chemically resistant hard plastic. The contact screw may be made of copper or brass, for example. The contact screw 100 is screwed to a current supply 106, which passes through the supporting frame 90 and is electrically insulated from the supporting frame by the insulation 108. The insulation 108 may be advantageously formed from a molding compound of self-curing plastic. A seal 110 is inserted between the pipe 94 of the supporting frame 90 and the shaking chute 4. The slideway 104 of the shaking chute 4 is provided with a bearing 112, which is used to transfer vibrations and may contain a spring element 114 made of steel, which is supported in a bearing block 116. The spring element has a surface coating of chemically resistant and electrically insulating material that does not need to be described in greater detail. The spring element 114 is moved by the cam 21.

In place of the spring element for transferring the vibrations of the chute driving mechanism to the shaking chutes 3 to 5, other bearing arrangements, such as a ball bearing, may be used.

To better intermix the agitatable material 10, the shaking chutes 3 to 5 may each have at least one step. Furthermore, the inclination of the shaking chutes 3 to 5 may be varied over their length. For example, the inclination may be greater at the ends of the chutes 3 to 5 near the cover 58 than at the ends of the chutes 3 to 5 near the cover 57. Also, the inclination may be greater at the two ends than in the middle. These various embodiments can prevent the agitatable material 10 from becoming lodged while it traverses the shaking chutes 3 to 5.

The invention has described an apparatus that can electrolytically deposit aluminum on an agitatable material. However, the apparatus may also be used for currentless surface treatments such as for cleaning, pickling or drying agitatable material. In addition, the apparatus is suitable for secondary treatments, such as for chromatizing already coated material.

What is claimed is:

1. An apparatus for surface treating agitatable material comprising: a conveyor trough for transporting the agitatable material, said trough at least partially submerged in a treatment bath and said trough including at least first and second shaking chutes each having a length and a direction along said length in which the material is conveyed, said first and second chutes disposed at angles from the horizontal such that the conveying direction of the first chute is substantially opposite to the conveying direction of the second chute.

2. The apparatus according to claim 1 wherein said surface treatment comprises galvanic deposition of metal from an electrolyte, at least said first and second shaking chutes being substantially maintained at a mutual potential.

3. The apparatus according to claim 2 further comprising a two-chamber sluice forming an admission sluice supplying the agitatable material.

4. The apparatus according to claim 1, further comprising a third shaking chute disposed above said first and second shaking chutes, said third shaking chute being at ground potential.

5. The apparatus according to claim 4 wherein said first and second shaking chutes are at least partially perforated and submerged in the treatment bath.

6. The apparatus according to claim 4 further comprising a two-chamber sluice forming an admission sluice supplying the agitatable material.

7. The apparatus according to claim 1 wherein said first chute is disposed above said second chute, said first chute being vibrated with a greater amplitude than said second chute.

8. The apparatus according to claim 1 wherein at least said first and second shaking chutes each have at least one step.

9. The apparatus according to claim 1 wherein at least said first and second shaking chutes are each disposed at angles from the horizontal that vary over said lengths thereof.

10. The apparatus according to claim 9 further comprising a driving motor having a selectable rotational frequency coupled to at least said first and second shaking chutes.

11. The apparatus according to claim 10 further comprising a material transport apparatus having adjustable transport speed.

12. The apparatus according to claim 1 further comprising a common driving motor coupled to at least said first and second shaking chutes.

13. The apparatus according to claim 12 further comprising at least one driving shaft coupled to said motor for shaking the shaking chutes, each of said shaking chutes having two engaging pieces engaging a cam coupled to said driving shaft.

14. The apparatus according to claim 13 further comprising a material transport apparatus having material baskets, a continuous conveyor belt for transporting said material baskets, and at least one tilting apparatus.

15. The apparatus according to claim 14 further comprising a spraying apparatus spraying a substance onto the agitatable material transported inside said materials baskets.

16. The apparatus according to claim 13 further comprising a material transport apparatus having a conveyor belt that is at least partially magnetizable.

17. The apparatus according to claim 13 further comprising a second shielding disposed between said shaking chutes and said driving shaft.

18. The apparatus according to claim 1 wherein said first shaking chute is disposed above said second shaking chute and further comprising a material transport apparatus transporting the agitatable material from said second shaking chute to said first shaking chute.

19. The apparatus according to claim 18 further comprising a first shielding disposed between said shaking chutes and said material transport apparatus.

20. The apparatus according to claim 18 further comprising an apportioning apparatus disposed between said second shaking chute and said material transport apparatus, said apportioning apparatus including a shaft extending perpendicular to the direction in which the agitatable material is conveyed, said shaft having lamellar separating walls extending along the axial direction of said shaft.

21. The apparatus according to claim 1 wherein said surface treatment is a galvanic deposition of aluminum onto said agitatable material from an aprotic, oxygen-free and anhydrous aluminum organic electrolytic solution and further comprising a gastight housing having at least one admission sluice for supplying the agitatable material and at least one exit sluice for removing the agitatable material.

22. The apparatus according to claim 1 further comprising a two-chamber sluice forming an admission sluice supplying the agitatable material.

23. The apparatus according to claim 22 wherein each of said sluice chambers having a blocking slide valve for sealing said chambers, each of said blocking slide valves being controllable independently of the other.

24. An apparatus for surface treating agitatable material comprising:

a conveyor trough for transporting the agitatable material, said trough at least partially submerged in a treatment bath and said trough including at least first and second shaking chutes each having a length and a direction along said length in which the material is conveyed, said first and second chutes disposed at angles from the horizontal such that the conveying direction of the first chute is substantially opposite to the conveying direction of the second chute;

a housing adapted to contain an electrolyte, said housing enclosing at least said conveyor;

anodes corresponding to each of said shaking chutes, said anodes each having anode leads; and cathode leads coupled to said shaking chutes, said anode leads and said cathode leads each passing through said housing and each being electrically insulated so that said leads are protected from an electrolyte.

25. An apparatus for surface treating agitatable material comprising: a conveyor trough for transporting the agitatable material, said trough at least partially submerged in a treatment bath and said trough including at least first and second shaking chutes each having a length and a direction along said length in which the material is conveyed, said first and second chutes disposed at angles from the horizontal such that the conveying direction of the first chute is substantially opposite to the conveying direction of the second chute; and a housing enclosing at least said trough, said housing having an inner coating forming an electrical and chemical insulator.

26. The apparatus according to claim 25 wherein said inner coating is phenolic resin.

* * * * *